United States Patent [19]

Valle

[11] Patent Number: 4,719,956

[45] Date of Patent: Jan. 19, 1988

[54] ADJUSTABLE WINDOW COVERING CORD LOCK

[75] Inventor: Louis G. Valle, Huntington Beach, Calif.

[73] Assignee: Beatrice Companies, Denver, Colo.

[21] Appl. No.: 7,464

[22] Filed: Jan. 28, 1987

Related U.S. Application Data

[63] Continuation of Ser. No. 714,876, Mar. 22, 1985, abandoned.

[51] Int. Cl.[4] ..... E06B 9/38

[52] U.S. Cl. ..... 160/178 C; 24/136 A; 29/DIG. 36; 148/902; 160/84 R

[58] Field of Search ..... 160/178 RB, 178 C, 148 R, 160/166 R, 84 R, DIG. 7; 24/136 A, 155 BR; 51/319; 29/DIG. 36; 148/902

[56] References Cited

U.S. PATENT DOCUMENTS 4,180,118 12/1979 Vecchiarelli ..... 160/178 C

FOREIGN PATENT DOCUMENTS 0059807 9/1982 European Pat. Off. ..... 160/178 C

*Primary Examiner*—J. Franklin Foss
*Assistant Examiner*—David L. Talbott
*Attorney, Agent, or Firm*—George J. Netter

[57] ABSTRACT

The adjustment cords of a window blind extend downwardly over a first pin fixedly located within a headrail. A second pin in the headrail adjacent the fixed pin has its ends slidably received in a slot enabling movement in a plane closely adjacent to the first pin. The second pin is in continuous contact with the cords and the relative dimensions of the pins and the cofining constraints of the headrail are such that for the standard diameter of the cord, locking engagement will be obtained when the two pins are located in the same horizontal plane. The guide slot for the second pin allows the pin to move to a point past the horizontal plane of normal locking engagement and closer to the fixed pin enabling locking engagement even if the cord diameter is less than normal. The second pin is constructed of a leaded steel subjected to sandblasting which produces a rough and pitted surface on the pin enhancing frictional engagement with the cord.

2 Claims, 7 Drawing Figures

FIG. 1
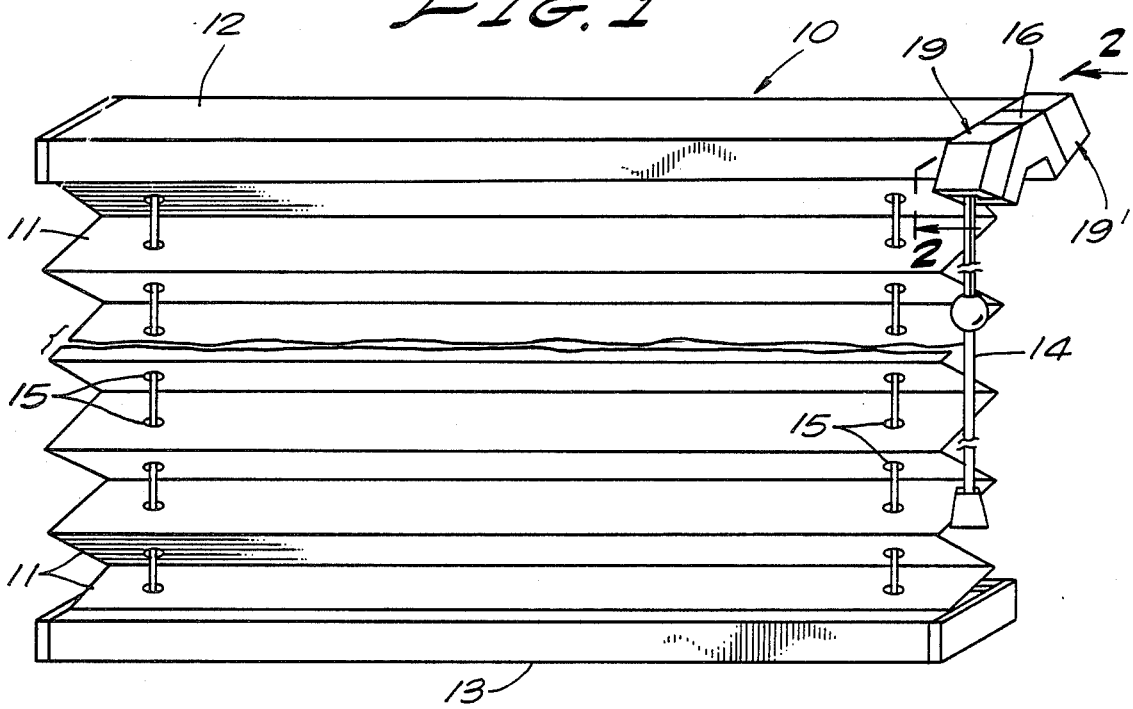
FIG. 2
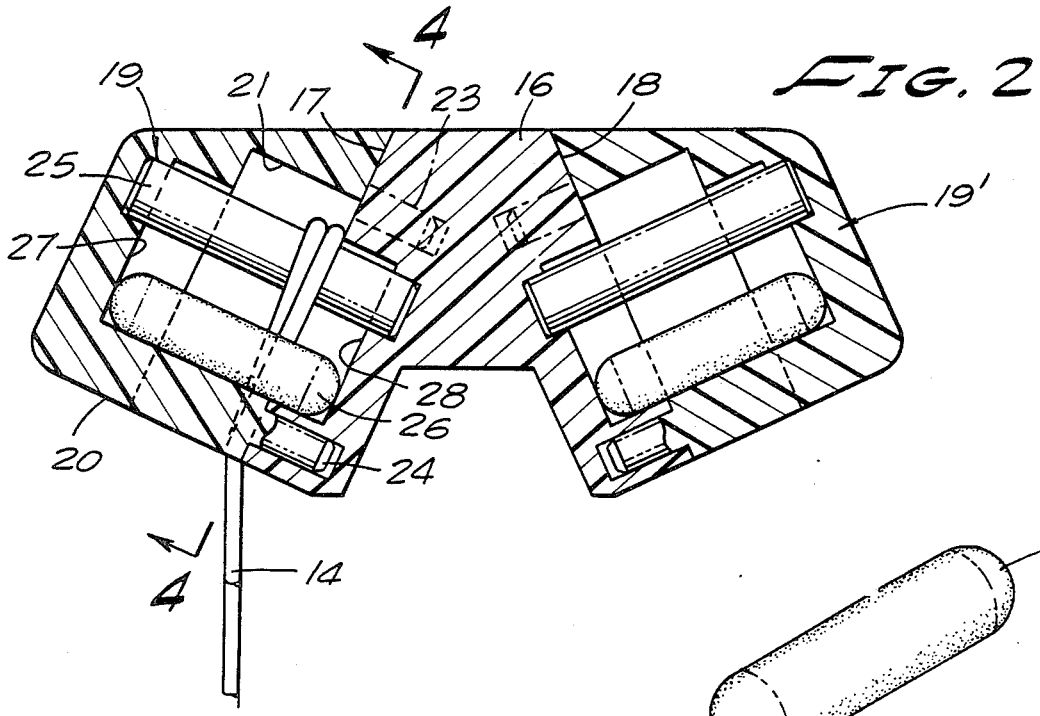
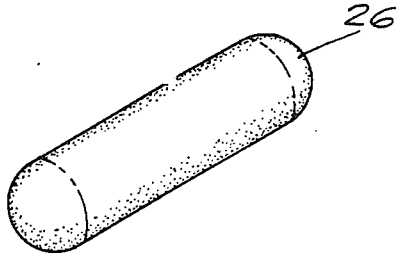
FIG. 3

ADJUSTABLE WINDOW COVERING CORD LOCK

This is a continuation of application Ser. No. 714,876 filed Mar. 22, 1985, now abandoned.

The present invention relates generally to a locking device for use on a window covering and, in particular, to such a locking device for automatically securing the adjustment position of one or more cords that are used to locate the blind height.

BACKGROUND OF THE INVENTION

A so-called venetian blind includes a plurality of slats which can be adjusted to various angles for controlling the amount of light passing therethrough and also may be raised or lowered to any desired height. A further well accepted form of window covering unit possessing some similarities to a conventional venetian blind, is a window covering consisting of a pleated fabric which can be raised or lowered to any desired height by cords extending through apertures in a pleated fabric. In both of these window covering units, adjustment of the cords to produce the desired height is typically accomplished by manipulation of the amount of cord which extends outwardly from the window covering and, more particularly, extends downwardly from a headrail located at the top of the window covering.

A highly desirable feature is that the cord used for positioning the height of the window covering or blind remains fixedly located after each adjustment. The very earliest approach to a solution for this problem was to provide a peg or stanchion about which the cord was tied. More recently, mechanical cord locks have been developed including pins between which the cords must pass and which pins accomplish a controlled amount of clamping force onto the cord at the conclusion of each height adjustment. Such cord locks, in the past have been subject to various deficiencies making them less than completely satisfactory in operation. For example, in certain prior cord locks, the specific means for obtaining the necessary cord force tended to induce substantial wear on a cord causing it to become frayed and eventually to break necessitating replacement. In certain other cord locks, the mechanical advantage of the various parts used to clamp the cord into a fixed position is insufficient making the cord lock unsteady and unreliable, in subjecting the cord lock device to the possibility of becoming disengaged allowing the blind to slip to some lower position. In still other types of known cord locks, the members that achieve the clamping of the cord tend, during use, to become burnished reducing the frictional engagement of the cord and allowing it to slip through with obvious undesirable results.

SUMMARY OF THE DISCLOSURE

A window covering blind or venetian blind interconnects with two or more vertically extending cords adjustable to raise and lower the blind to any desired height. The cords at the upper end extend through a common headrail and pass over an internally contained, transversely extending cylindrical pin which guides the cords downwardly and upwardly in the headrail. A second cylindrical pin in the headrail adjacent the fixed pin has its ends slidably received in slots enabling the second pin to move in a plane closely adjacent to the first pin. More particularly, the plane of sliding movement of the second pin is such that the movable pin is in continuous contact with the cord throughout its complete path of movement and the relative dimensions of the pins and the confining constraints of the headrail are such that for the standard diameter of the cord, locking engagement will be obtained when the two pins are located in the same horizontal plane. Still further, the wall portions of the headrail defining the slot for the movable pin are such that in the event of wear of the cord to a smaller than standard diameter, the pin can move to a point past the horizontal plane of normal locking engagement above it and to a point which is sufficiently close to the fixed pin to lockingly engage the cord despite the reduced cord diameter.

The movable pin is constructed of a leaded steel subjected to sandblasting which produces a rough and pitted surface on the pin thereby enhancing its frictional engagement characteristics with the cord.

DESCRIPTION OF THE DRAWINGS

FIG. 1 is a perspective view of a window covering unit including the cord lock to be described and depicted at a predetermined adjustment position.

FIG. 2 is an end elevational, sectional view taken along the line 2—2 of FIG. 1.

FIG. 3 is a perspective enlarged view of a movable pin of the cord lock shown after surface treating.

DESCRIPTION OF A PREFERRED EMBODIMENT

Figure 4:
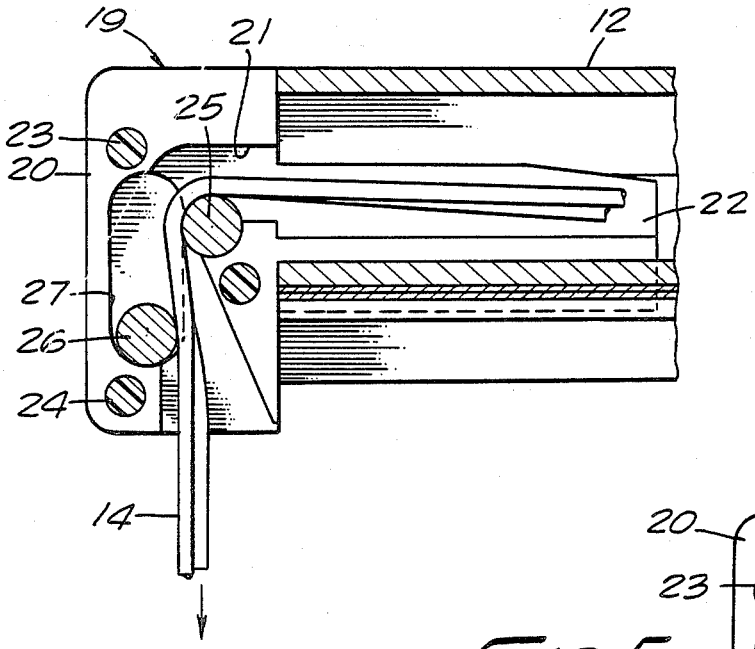
FIG. 4 is a sectional view taken along the line 4—4 of FIG. 2 showing the cord unlocked.

With reference to the drawing and especially FIG. 1, the window covering unit with which the invention described herein is most advantageously utilized is identified generally as a 10 and typically includes pleated blind material 11 having an upper edge connected to a so-called headrail 12 and a lower edge connected to a bottom rail 13. Without regard to specific operation or detail aspects thereof, adjustment of height of the blind (i.e., spacing of the bottom rail 13 from the headrail 12) is accomplished by manipulation of a pull cord 14 which is threaded through the headrail and a plurality of blind openings 15 with its opposite end connected to the bottom rail 13. As will be more particularly described herein, with the pull cord 14 left in its generally vertical hanging condition, an internal cord lock secures the cord, and thus the entire window covering unit, at the corresponding height. To release the cord lock, the pull cord 14 is moved angularly to the middle which allows the blind material 11 and bottom rail 13 to be released downwardly to a new position.

Turning to FIG. 2 which is a sectional view looking directly into the cord lock of this invention and toward the end of the headrail 12, the lock housing is seen to include a central, generally triangular shaped base 16 having first and second flat faces 17 and 18 directed generally angularly upwardly, the first face also facing towards the front of the blind and the second toward the rear of the blind. It is to be noted that although there is only one locking mechanism identified generally as at 19 used, it can be fitted onto the surface 17 or, optionally, onto the surface 18 where the locking mechanism is identified as 19'. The optional arrangement enables locating the cord lock (and thus the cord) at either end of the headrail 12 as may be necessary to accomodate situations where a wall is closely adjacent one end making it more convenient to locate the cord at the opposite end. However, the remainder of the description of the cord lock construction and its various parts will be confined to the situation as it is depicted at 19, with it being understood that construction and operation of 19' is the same.

The lock housing 20 has walls defining a hollow interior with an inlet opening 21 (FIG. 4) through which the pullcord 14 extends and keying wall members 22 are fittingly received within the open end of the headrail 12. In general assembly, the lock housing keying wall members 22 fit into the open end of the headrail such that the housing 20 is unitarily related to the outer end of the headrail. The pullcord 14 moves upwardly through the opening 21 and turns at right angles to pass along the interior opening of the headrail 12. Pins 23 and 24 in the housing 20 secure the housing to the central triangular member 16.

Still referring to FIG. 2, a metal cylindrical pin 25 has one end fixedly located within an opening in the base 16 and its opposite end received in a similar opening in the cap 20 in which manner the pin extends generally 90 degrees to the surface 17. The fixed roller 25 serves as a bearing surface over which the cord 14 moves to change the cord direction from a generally vertical one to a generally horizontal plane within the headrail 12. A second metal pin 26 has its end portions received within slightly oversized slots 27 and 28 in the base 16 and cap 20, respectively, enabling the pin to move in a direction generally transversely of the headrail longitudinal dimension as indicated in FIG. 4, for example. These slots are elongated and lie outwardly of the fixed pin 25 (i.e., towards the outer end of the housing 20), forming a plane of movement for the movable pin substantially parallel to the outer end of the headrail except at the upper end portion as will be more particularly described.

Figure 5:
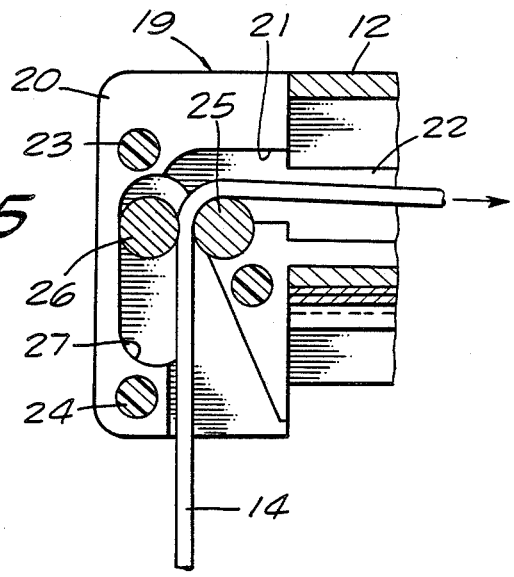
FIG. 5 is a sectional view similar to FIG. 4 showing a normal diameter cord locked.

The pin 26 is sufficiently undersized in cross-section as compared to the cross-sectional dimensions of slots 27 and 28, that it will also readily rotate about its longitudinal axis as it slides along the slots. The diameter of the two pins 25 and 26 as well as the dimensions of slots 27 and 28 are such that when the cord 14 is in place and threaded between the two pins the movable pin on moving upwardly completely locks the cord between the fixed and movable pin when the two pin centers are substantially horizontally aligned (FIG. 5). That is, when a new or normal diameter cord or plurality of such cords are located between the pins, normal locking engagement is achieved when the two pins are in a horizontal plane.

During the normal course of use, the cord diameter will tend to be abraded and reduced such that locking engagement can no longer be obtained when the pins 25, 26 are horizontal as shown in FIG. 5. However, because of the curvature and width at the upper ends of the slots 27 and 28, as the movable pin moves upwardly past the horizontal plane condition of FIG. 5 to a position as shown in FIG. 6, the movable pin will be moved further toward the fixed pin and thus still be able to lockingly engage the thinner diameter cord.

Figure 6:
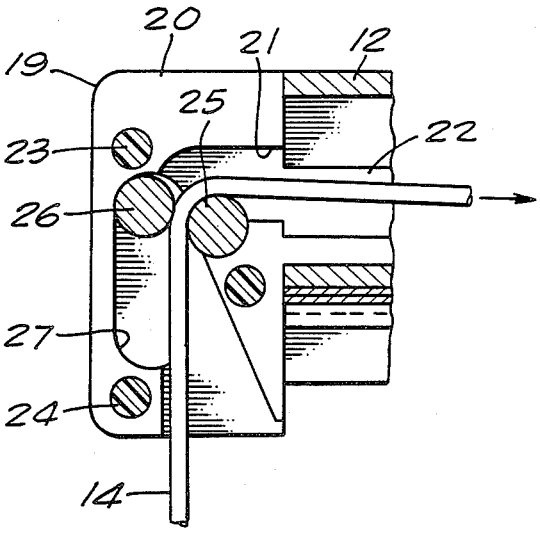
FIG. 6 is a sectional view similar to FIG. 5 showing the locked condition applied to a cord of reduced diameter.
Figure 7:
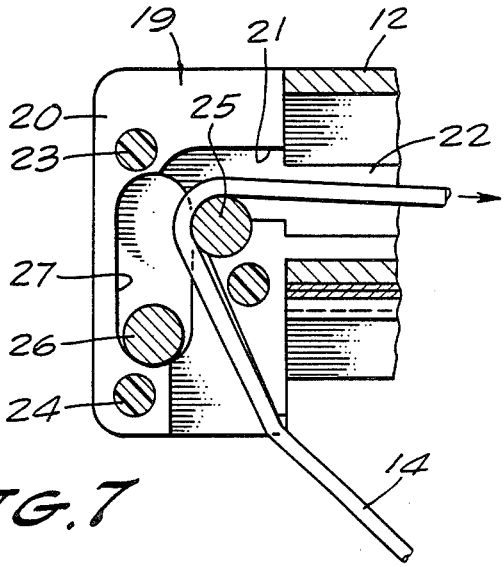
FIG. 7 is a view similar to FIGS. 4 through 6 showing the cord in a fully released condition during blind height adjustment.

On comparison of FIGS. 4, 5 and 6, at this time, with the pull cord 14 in generally vertical hanging condition, on pulling downwardly as shown by the arrow in FIG. 4, the cord 14 engages the movable pin holding it and pulling it towards the bottom rail. Upon release of the cord when a particular position of adjustment of the blind is obtained, the frictional contact between the movable pin 26 and the cord will cause it to pull the pin 26 upwardly to the locked position shown in FIG. 5. If the cord is of reduced diameter, then the pin 26 will move above the horizontal plane of pin 25 as shown in FIG. 6 before it is locked.

FIG. 3 shows an enlarged view of the movable pin 26 which is seen to have a surface that is uniformly pitted throughout its entire periphery. Also, the ends of the movable pin are seen to be rounded to a substantial radius. The purpose of the pitting is to form a highly frictional surface for engaging the cord and insuring movement of the pin 26 when so engaged. Rounding the pin ends prevents the pin from becoming jammed in either or both of the slots 27 and 28 which, of course, would make the entire apparatus inoperative.

The preferable way of producing a movable pin 26 having the desirably high frictional surface is to construct the pin from a leaded steel and then sandblasting the surface of the pin which provides a very finely pitted surface. The lead steel and sandblasting are relatively inexpensive and simple to accomplish. It is possible to achieve a highly frictional surface by machining a wholly steel pin, but this would be prohibitively expensive for high volume quantity production. Also, if softer materials are used for the movable pin 26, such as brass or copper, surface treatments of these materials do not produce a satisfactory pin in that the pin quickly wears down to form a relatively low friction surface as a result of the constant abrading with the cord passing thereover.

I claim:

1. In a window blind having a headrail housing with a base and a cap-like member fitted onto the base foring an enclosure, a locking device for a height adjusting cord including a first pin with its ends fixedly mounted in the respective headrail base and cap-like member and located within the enclosure, a second pin having its ends portions slidingly confined in slots formed in the headrail base and cap-like member to move along a gravity path within the enclosure in a plane including said second pin from a first position spaced from said first pin a distance less than the cord thickness to a second position spaced from said first pin a distance substantially greater than the cord thickness, the improvement comprising:

the second pin is constructed of a material that has spaced apart relatively soft portions separated by relatively hard portions, said relatively soft portions having outwardly facing surfaces removed to form pits and being abradable by the adjusting cord to provide said second pin with a continuously pitted peripheral surface.

2. A window blind as in claim 1, in which the second pin is constructed of a leaded steel and is sand-blasted to produce initial surface pitting.

* * * * *